US012043426B2

(12) United States Patent
Morijiri

(10) Patent No.: US 12,043,426 B2
(45) Date of Patent: Jul. 23, 2024

(54) BINDING MACHINE

(71) Applicant: MAX CO., LTD., Tokyo (JP)

(72) Inventor: Takeshi Morijiri, Tokyo (JP)

(73) Assignee: Max Co., Ltd., Tokyo (JP)

( * ) Notice: Subject to any disclaimer, the term of this patent is extended or adjusted under 35 U.S.C. 154(b) by 576 days.

(21) Appl. No.: 17/260,857

(22) PCT Filed: Jul. 18, 2019

(86) PCT No.: PCT/JP2019/028362

§ 371 (c)(1),
(2) Date: Jan. 15, 2021

(87) PCT Pub. No.: WO2020/017612

PCT Pub. Date: Jan. 23, 2020

(65) Prior Publication Data

US 2021/0269184 A1 Sep. 2, 2021

(30) Foreign Application Priority Data

Jul. 18, 2018 (JP) ..... 2018-135390

(51) Int. Cl.
*B65B 13/28* (2006.01)
*B65B 13/02* (2006.01)
(Continued)

(52) U.S. Cl.
CPC ..... *B65B 13/285* (2013.01); *B65B 13/025* (2013.01); *B65B 27/10* (2013.01); *B65B 57/04* (2013.01); *B65B 59/001* (2019.05)

(58) Field of Classification Search
CPC ..... B21F 15/00; B21F 15/02; B21F 15/04; B65B 13/22; B65B 13/28; B65B 13/285;
(Continued)

(56) References Cited

U.S. PATENT DOCUMENTS 5,678,613 A 10/1997 Murayama et al.
5,944,064 A 8/1999 Saito et al.
(Continued)

FOREIGN PATENT DOCUMENTS

CN 1535229 A 10/2004
CN 101522529 A 9/2009
(Continued)

OTHER PUBLICATIONS

Translation of WO-2017199858 (Year: 2017).*
(Continued)

*Primary Examiner* — Bobby Yeonjin Kim
(74) *Attorney, Agent, or Firm* — Banner & Witcoff, Ltd.

(57) ABSTRACT

A binding machine includes: a holding portion configured to hold a tip end side of a cured wire rod; a feed unit configured to hold a base end side of the wire rod, the tip end side of which is held by the holding portion, such that the base end side of the wire rod is able to be fed out; a twisting unit configured to twist the wire rod; and a control unit configured to control the feed unit and the twisting unit. The control unit is configured to control the feed unit to feed the wire rod when detecting a first signal, and is configured to control the twisting unit to twist the wire rod when detecting a second signal.

9 Claims, 14 Drawing Sheets

(51) Int. Cl.
*B65B 27/10* (2006.01)
*B65B 57/04* (2006.01)
*B65B 59/00* (2006.01)

(58) Field of Classification Search
CPC ..... B65B 13/025; B65B 13/04; B65B 13/06; B65B 27/10; B25B 25/00; E04G 21/123
See application file for complete search history.

(56) References Cited

U.S. PATENT DOCUMENTS

| | | | | |
|---|---|---|---|---|
| 6,401,766 | B1 | 6/2002 | Ishikawa et al. | |
| 2005/0005991 | A1 | 1/2005 | Ishikawa et al. | |
| 2009/0283168 | A1 | 11/2009 | Kusakari | |
| 2009/0283172 | A1 * | 11/2009 | Itagaki | B65B 13/22 242/421 |
| 2017/0218631 | A1 | 8/2017 | Matsuno | |
| 2017/0334587 | A1 | 11/2017 | McFall et al. | |
| 2018/0195299 | A1 | 7/2018 | Itagaki | |
| 2019/0093374 | A1 | 3/2019 | Machida et al. | |
| 2020/0149279 | A1 | 5/2020 | Matsuno | |
| 2021/0189746 | A1 | 6/2021 | Itagaki | |

FOREIGN PATENT DOCUMENTS

| | | | | | |
|---|---|---|---|---|---|
| CN | 107031891 | A | | 8/2017 | |
| CN | 107161375 | A | | 9/2017 | |
| JP | H09-165005 | A | | 6/1997 | |
| JP | H09156608 | A | * | 6/1997 | B65B 13/18 |
| JP | H09156608 | A | | 6/1997 | |
| JP | 2001038647 | A | | 2/2001 | |
| JP | 2004142782 | A | | 5/2004 | |
| JP | 5126101 | B2 | | 1/2013 | |
| JP | 2017206923 | A | | 11/2017 | |
| JP | 2018109295 | A | | 7/2018 | |
| KR | 100423385 | B1 | | 7/2004 | |
| KR | 20170131236 | A | | 11/2017 | |
| TW | 201718346 | A | | 6/2017 | |
| WO | WO-2017199858 | A1 | * | 11/2017 | B21F 15/06 |

OTHER PUBLICATIONS

Translation of JP-H09156608 (Year: 1997).*
European Search Report for EP Application No. 19836961.3 dated Mar. 21, 2022. (8 pp.).
Chinese Office Action dated Aug. 31, 2022, issued by the China National Intellectual Property Administration in the corresponding Chinese Patent Application No. 201980047627.3. (8 pages).
International Search Report and Written Opinion issued in Application No. PCT/JP2019/028362 dated Sep. 3, 2019, 10 pages.
Chinese Office Action for CN Application No. 201980047627.3 dated Apr. 8, 2022. (16 pp.).
Sep. 18, 2023—(KR) Request for the Submission of an Action—App 10-2021-7001340.

* cited by examiner

BINDING MACHINE

CROSS REFERENCE TO RELATED APPLICATION

This application is a 35 U.S.C. 371 National Phase Entry Application from PCT/JP2019/028362, filed Jul. 18, 2019, which claims priority to Japanese Patent Application No. 2018-135390, filed Jul. 18, 2018, the disclosures of which are incorporated herein in their entirety by reference, and priority is claimed to the foregoing.

TECHNICAL FIELD

The present disclosure relates to a binding machine that binds a binding object such as a reinforcing bar with a wire rod such as a wire.

BACKGROUND ART

A binding machine called a reinforcing bar binding machine that enables binding of reinforcing bars by operating a trigger switch is widely used (for example, Patent Literature 1). This type of reinforcing bar binding machine is configured by an accommodation chamber that accommodates a wire reel on which a wire is wound; a feed unit that feeds the wire wound on the wire reel; a guide portion that winds the wire around reinforcing bars by giving a curl nature to the wire fed by the feed unit; and a wire twisting device that grips and twists the wire wound around the reinforcing bars.

A lower guide is provided below the guide portion so as to face the guide portion. The lower guide receives the wire from the guide portion and guides the received wire to the wire twisting device. The guide portion and the lower guide form a C shape in a side view with tip ends thereof open, and in order to bind reinforcing bars, the reinforcing bars are inserted between the opening, that is, between the guide portion and the lower guide.

CITATION LIST

Patent Literature

Patent Literature 1: Japanese Patent No. 5126101

SUMMARY OF INVENTION

Technical Problem

In order to bind the reinforcing bars using the reinforcing bar binding machine, it is necessary to insert the reinforcing bars to be bound between the guide portion and the lower guide. Therefore, the number and thickness of the reinforcing bars that can be bound are restricted by a dimension between the guide portion and the lower guide. For example, even it attempts to bind five or more reinforcing bars, the reinforcing bars cannot be bound by the binding machine if the reinforcing bars cannot be inserted between the guide portion and the lower guide. The dimension between the guide portion and the lower guide may be increased in order to bind more reinforcing bars, but if the dimension is increased, the device is increased in size and the weight balance is lost, which hinders operability. This problem gets serious as the number and thickness of the reinforcing bars to be bound increase.

If it is difficult to bind reinforcing bars with a reinforcing bar binding machine for the reason that the number of reinforcing bars to be bound is large, a worker can bind the reinforcing bars by his/her own hands, but manual binding is time-consuming and results in a heavy workload on the worker.

The present disclosure has been made to solve such a problem, and an object of the present disclosure is to provide a binding machine that can bind binding objects of various sizes.

Solution to Problem

A binding machine according to the present disclosure includes: a holding portion configured to hold a tip end side of a cured wire rod; a feed unit configured to hold a base end side of the wire rod, the tip end side of which is held by the holding portion, such that the base end side of the wire rod is able to be fed out; a twisting unit configured to twist the wire rod; and a control unit configured to control the feed unit and the twisting unit. The control unit is configured to control the feed unit to feed the wire rod when detecting a first signal, and is configured to control the twisting unit to twist the wire rod when detecting a second signal.

According to the binding machine described above, the tip end side and the base end side of the curled wire rod are respectively held by the holding portion and the feed unit, and thus the wire rod between the holding portion and the feed unit forms an annular wire loop. Then, binding objects are inserted into (inside) the wire loop, and the binding objects can be bound when the wire rod is twisted by the twisting unit.

The feed amount of the wire rod by the feed unit can be controlled by the control unit, and thus a size of the wire loop can be freely adjusted. Therefore, as long as the size of the wire loop is adjusted to match a size of the binding object, binding objects of various sizes can be bound.

A binding machine according to another aspect of the present disclosure includes: a feed unit configured to hold a base end side of a wire rod, a tip end side of which is open, such that the base end side of the wire rod is able to be fed out; a holding portion configured to hold the tip end side of the wire rod that is fed out by the feed unit; a twisting unit configured to twist the wire rod, the tip end side of which is held by the holding portion; and a control unit configured to control the feed unit and the twisting unit. The control unit is configured to control the feed unit to feed the wire rod when detecting a third signal, is configured to control the holding portion to hold the tip end side of the wire rod when detecting a fourth signal, and is configured to control the twisting unit to twist the wire rod when detecting a fifth signal.

According to the binding machine described above, the wire rod, the tip end side of which is open is wound around the binding objects, the tip end side of the wire rod is held by the holding portion, then the wire rod is twisted by the twisting unit, and thus the binding objects can be bound.

Since the base end side of the wire rod, the tip end side of which is open can be fed out by the feed unit (a feed amount of the wire rod is controlled by the control unit), as long as the feed amount of the wire rod is controlled, that is, as long as the wire rod is fed to an extent that the binding objects can be wound, binding objects of various sizes can be bound.

A binding machine according to another aspect of the present disclosure includes: a body portion; a holding portion configured to hold a tip end side of a cured wire rod; a feed unit configured to hold a base end side of the wire rod, the tip end side of which is held by the holding portion, such that the base end side of the wire rod is able to be fed out; and a twisting unit configured to twist the curled wire rod. A closed annular wire rod is formed on a tip end side of the body portion by the holding portion and the feed unit, and a diameter of the annular wire rod is able to be expanded by feeding the base end side of the wire with the feed unit.

According to the binding machine described above, the loop diameter of the looped annular wire can be adjusted according to a size (diameter) of the binding objects by adjusting the feed amount of the wire rod. Therefore, binding objects of various sizes can be bound.

Advantageous Effects of Invention

According to the present disclosure, by controlling the feed amount of the wire rod, the curl diameter of the curled wire rod or the pull-out amount of the wire rod, the tip end side of which is open can be freely adjusted, so that even if the binding objects have various sizes, the binding can be performed.

DESCRIPTION OF EMBODIMENTS

First Embodiment

Hereinafter, preferred embodiments of the present disclosure will be described with reference to the drawings.

Figure 1:
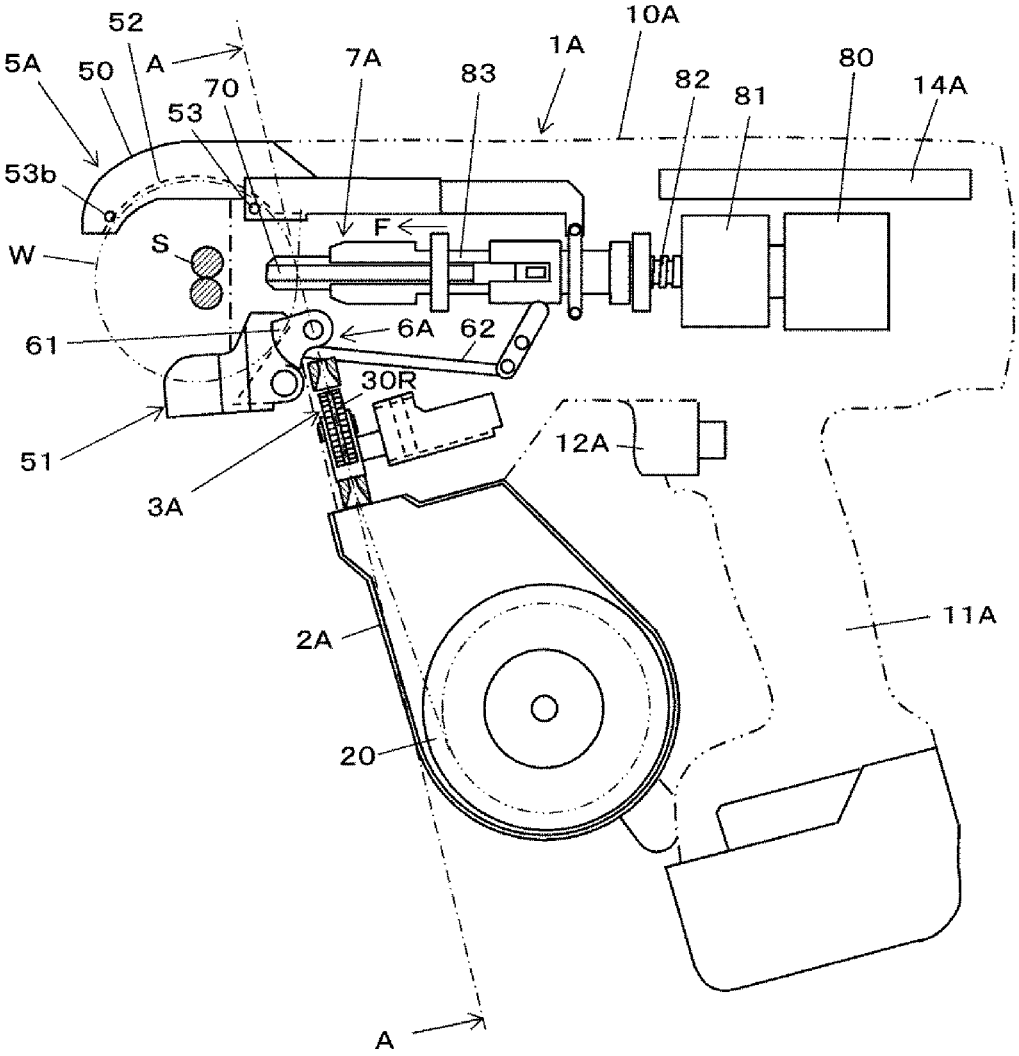
FIG. 1 is a side view showing an example of an overall configuration of a reinforcing bar binding machine according to a first embodiment.
Figure 2:
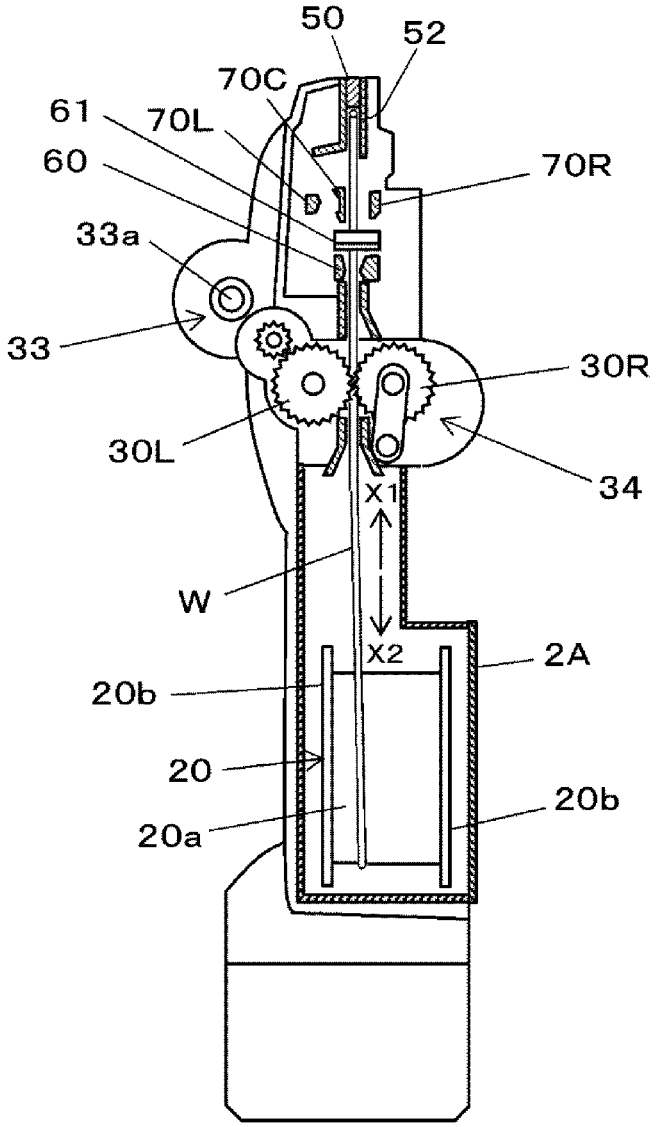
FIG. 2 is a cross-sectional view taken along a line A-A in FIG. 1.

FIG. 1 is a side view showing an example of an overall configuration of a reinforcing bar binding machine 1A according to a first embodiment, and FIG. 2 is a cross-sectional view taken along a line A-A in FIG. 1.

The reinforcing bar binding machine 1A includes a body portion 10A, a handle portion 11A that protrudes from the body portion 10A, and a curl guide 5A that is provided on a tip end side of the body portion 10A and curls a wire W by giving a curl nature to the wire W. A trigger switch 12A is provided on the handle portion 11A. Here, the "giving a curl nature to the wire W" or "curls a wire W" means to bend the wire W into an arc shape or a curved shape (However, the wire W does not necessarily have to be a gentle arc or curve, and those that are slightly sharply bent are included). Further, the "curled wire W" means a wire W bent in this way.

In the following description, a side where the handle portion 11A is provided with respect to the body portion 10A is set as a lower side, an opposite side thereof is set as an upper side, a side where the curl guide 5A is provided with respect to the body portion 10A is set as a front side, and an opposite side thereof is set as a rear side.

A reel accommodation portion 2A for accommodating a wire reel 20 around which the wire W is wound is attached to the body portion 10A. Inside the body portion 10A, a wire feed unit (feed unit) 3A that pulls out the wire W from the wire reel 20 accommodated in the reel accommodation portion 2A and feeds the wire W, a cutting unit 6A that cuts the wire W curled by the curl guide 5A, a binding unit (twisting unit) 7A that holds and twists the wire W cut by the cutting unit 6A, and a control unit 14A that controls the wire feed unit 3A and the binding unit 7A are provided.

The wire reel 20 includes a tubular hub portion 20*a* around which the wire W is wound, and a pair of flanges 20*b* that are provided on both axial ends of the hub portion 20*a*. The flange 20*b* has a diameter larger than a diameter of the hub portion 20*a*, and projects radially from both axial ends of the hub portion 20*a*.

The reel accommodation portion 2A is provided below the body portion 10A so as to be located in front of the handle portion 11A. The reel accommodation portion 2A includes a wall portion (not shown) defining a space that can accommodate the wire reel 20, and a reel support shaft (not shown) projecting from the wall portion into the reel accommodation portion 2A. The wire reel 20 is rotatably supported by the reel support shaft, and when the wire W is fed by the wire feed unit 3A, the wire reel 20 rotates in accordance with the wire W.

The wire feed unit 3A is located above the reel accommodation portion 2A, and includes a pair of feed gears 30L, 30R for feeding wire W, a drive unit 33 for driving one of the pair of feed gears 30L, 30R (the first feed gear 30L in the present embodiment), and a displacement portion 34 for displacing the other gear (the second feed gear 30R in the present embodiment) so as to be separated from or in contact with the first feed gear 30L. The first and second feed gears 30L, 30R are both spur gears, and are arranged such that outer peripheral surfaces thereof face each other with a feed path of the wire W sandwiched therebetween. In order to feed the wire W, the wire W is set between the first feed gear 30L and the second feed gear 30R, the second feed gear 30R is brought into contact with the first feed gear 30L by the displacement portion 34, the wire W is sandwiched (held), and then the drive unit 33 drives the first feed gear 30L. The first feed gear 30L and the second feed gear 30R are not necessarily limited to spur gears as long as the first feed gear 30L and the second feed gear 30R can properly feed the wire W.

The drive unit 33 is configured by a feed motor 33*a*, and a gear that is connected to an output shaft of the feed motor 33*a* so as to transmit a driving force of the feed motor 33*a* to the first feed gear 30L. By switching a rotation direction of the output shaft of the feed motor 33*a*, rotation directions of the first feed gear 30L and the second feed gear 30R can be switched and forward and reverse feed directions of the wire W can be switched. In the present embodiment, the wire W is fed by rotating the output shaft of the feed motor 33*a* in a forward direction, and the wire W is pulled back by rotating the output shaft in a reverse direction.

The curl guide 5A is provided on a tip end side of the body portion 10A, and is configured by a pair of upper and lower guide portions, that is, a first guide portion 50 and a second guide portion 51. The first guide portion 50 is provided above the binding unit 7A of the body portion 10A, and gives a curl nature to the wire W. The second guide portion 51 is provided below the binding unit 7A of the body portion 10A, receives the wire W curled by the first guide portion 50, and guides the wire W to the binding unit 7A. The curl guide 5A is configured by the first guide portion 50 and the second guide portion 51 such that tip end sides thereof are opened so as to form a C shape in a side view. In order to bind the reinforcing bars S, the reinforcing bars S are inserted between the opening, that is, between the first guide portion 50 and the second guide portion 51.

The first guide portion 50 includes a guide groove 52 that forms at least a part of a feed path of the wire W through which the wire W passes. The guide groove 52 is formed in a curved (arc) shape along a traveling direction of the wire W. The guide groove 52 is provided with guide pins 53, 53*b* that are abutted with the wire W and regulate the traveling direction of the wire W. The guide pin 53 is provided in a vicinity of an inlet (introduction port of the wire W) of the guide groove 52, and is abutted with the wire W from a lower side (an inner side of the curled wire W). The guide pin 53*b* is provided in a vicinity of an outlet of the guide groove 52, and is abutted with the wire W from an upper side (an outer side of the curled wire W). In a process of passing through the first guide portion 50, the wire W is abutted with the guide pin 53, the guide groove 52, and the guide pin 53*b*. As a result of the wire W passing through the first guide portion 50 while a traveling direction is regulated by the guide pin 53, the guide groove 52, and the guide pin 53*b*, the wire W is curled.

The second guide portion 51 includes a guide groove that receives the wire W from the first guide portion 50 and guides the wire W to the binding unit 7A.

The cutting unit 6A is provided between the wire feed unit 3A and the curl guide 5A, and includes a fixed blade 60 having a through hole through which the wire W can pass, and a movable blade 61 that slides on an outer peripheral surface of the fixed blade 60. In order to cut the wire W by the cutting unit 6A, the movable blade 61 is slid along an outer peripheral surface of the fixed blade 60 in a state where the wire W penetrates the through hole of the fixed blade 60. A twisting motor 80 of the binding unit 7A is used to drive the movable blade 61. A driving force of the twisting motor 80 is transmitted to the movable blade 61 via a link 62 or the like, and the movable blade 61 slides on the outer peripheral surface of the fixed blade 60 due to the drive of the twisting motor 80.

The binding unit 7A includes the twisting motor 80; a speed reduction mechanism 81 that reduces a speed of the twisting motor 80 and amplifies torque thereof; a rotating shaft 82 that is connected to the speed reduction mechanism 81 and rotates due to the rotation of the twisting motor 80; a movable member 83 that is displaced due to rotational movement of the rotating shaft 82; and a holding portion 70 that protrudes toward a tip end side of the movable member 83 and holds and twists the wire W.

Screws are formed on an outer peripheral surface of the rotating shaft 82 and an inner peripheral surface of the movable member 83, and the screw of the rotating shaft 82 is screwed into the screw of the movable member 83. In a state where rotation of the movable member 83 is regulated, the movable member 83 moves in a front-rear direction when the rotating shaft 82 rotates, and rotates integrally with the rotating shaft 82 when the rotation regulation is released.

The holding portion 70 has a plurality of claw portions (a first movable holding member 70L, a second movable holding member 70R, and a fixed holding member 70C, which are to be described later) for holding the wire W. The holding portion 70 opens and closes according to the movement of the movable member 83 in the front-rear direction, and rotates according to the rotational movement of the movable member 83.

Figure 3:
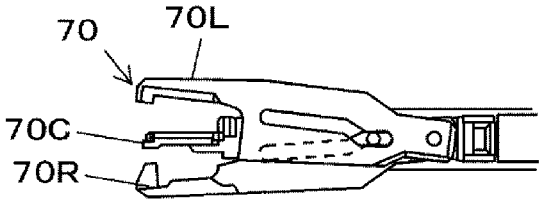
FIG. 3 is a side view of a holding portion according to the first embodiment.
Figure 4A:
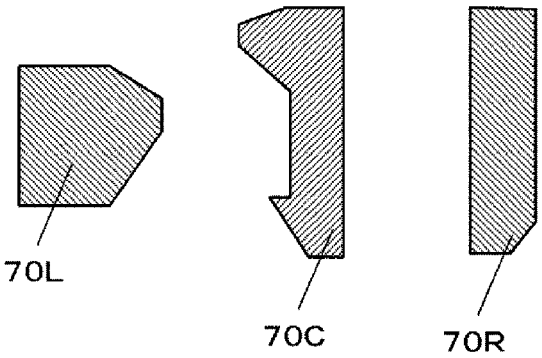
FIG. 4A is an enlarged view of main parts of the holding portion according to the first embodiment.
Figure 4B:
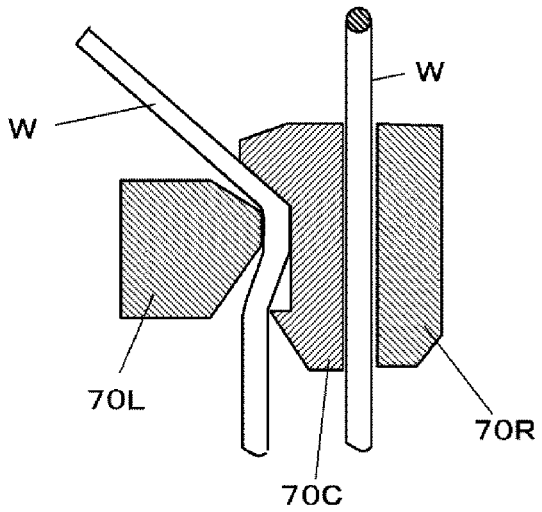
FIG. 4B is an enlarged view of main parts of the holding portion according to the first embodiment and shows an example in which a wire is sandwiched.

FIG. 3 is a side view of the holding portion 70, and FIGS. 4A and 4B are enlarged views of main parts of the holding portion 70.

The holding portion 70 includes the fixed holding member 70C, the first movable holding member 70L, and the second movable holding member 70R. The first movable holding member 70L and the second movable holding member 70R are arranged in a left-right direction with the fixed holding member 70C interposed therebetween. The first movable holding member 70L and the second movable holding member 70R approach or move away from the fixed holding member 70C in accordance with the movement of the movable member 83 in the front-rear direction.

When the first movable holding member 70L and the second movable holding member 70R are separated from the fixed holding member 70C, feed paths through which the wire W passes are formed between the first movable holding member 70L and the fixed holding member 70C and between the second movable holding member 70R and the fixed holding member 70C, respectively. Therefore, the wire W fed by the wire feed unit 3A first passes between the second movable holding member 70R and the fixed holding member 70C, is curled by the curl guide 5A, and then passes between the first movable holding member 70L and the fixed holding member 70C. In this state, the first movable holding member 70L approaches the fixed holding member 70C, and thus the wire W is held (gripped) by the first movable holding member 70L and the fixed holding member 70C.

The second movable holding member 70P is also configured to approach the fixed holding member 70C similarly to the first movable holding member 70L, but the second movable holding member 70R does not grip the wire W even when the second movable holding member 70R is closest to the fixed holding member 70C. That is, even when the second movable holding member 70R is closest to the fixed holding member 70C, the wire W is in a state of being able to pass between the second movable holding member 70R and the fixed holding member 70C. Thus, in a state where a tip end side (including not only the tip end portion but also a vicinity of the tip end portion) of the wire that is curled to an arc shape, that is, a wire loop is held between the first movable holding member and the fixed holding member 70C, a base end side (in the case of the present embodiment, the base end side means a wire portion that is upstream of a position where the wire W of the wire loop intersects and exists at a position of the wire feed unit 3A) of the wire loop can be fed or pulled back.

Figure 5:
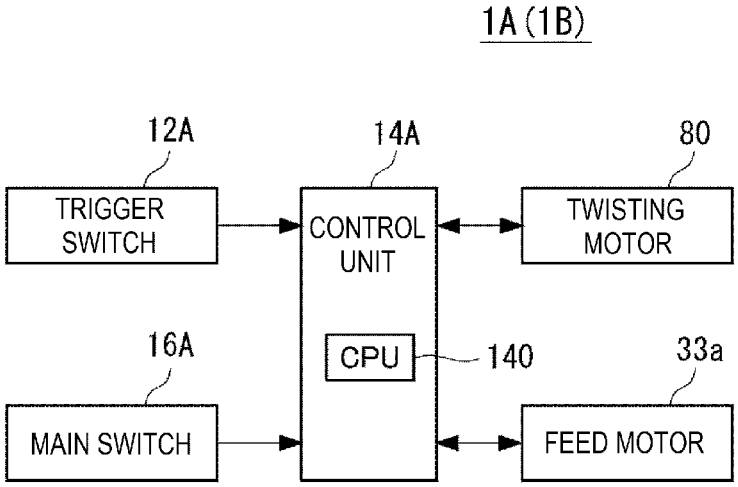
FIG. 5 is a block diagram showing an example of a control function of the reinforcing bar binding machine according to the first embodiment.

FIG. 5 is a block diagram showing an example of a control function of the reinforcing bar binding machine 1A. As shown in FIG. 5, the reinforcing bar binding machine 1A includes a control unit 14A including a Central Processing Unit (CPU) 140, a memory and, an input/output interface. The control unit 14A controls an operation of the entire reinforcing bar binding machine 1A by executing a program stored in the memory such as a ROM.

A main switch 16A, the trigger switch 12A, the feed motor 33*a*, and the twisting motor 80 are connected to the control unit 14A. The control unit 14A controls power on/off of the reinforcing bar binding machine 1A based on a signal from the main switch 16A.

The control unit 14A controls the feed motor 33*a* or the twisting motor 80 based on/off signals from the trigger switch 12A.

Figure 6:
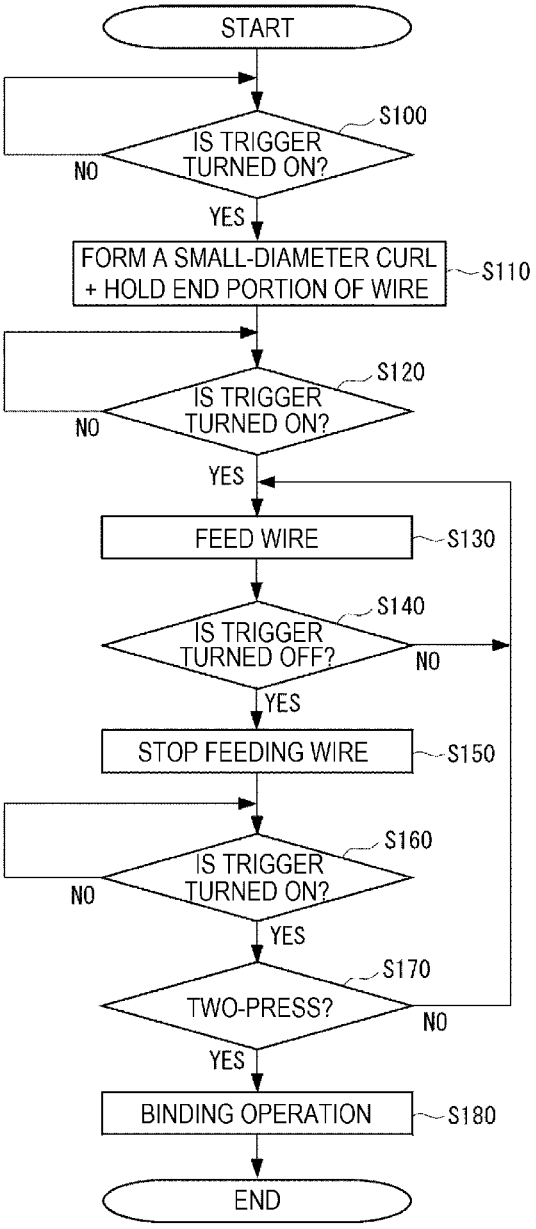
FIG. 6 is a flowchart showing an example of control of the reinforcing bar binding machine according to the first embodiment.

FIG. 6 is a flowchart showing an example of control of the reinforcing bar binding machine 1A according to the present embodiment. The reinforcing bar binding machine 1A executes processing shown in FIG. 6 by executing a program stored in a memory (not shown). Further, FIGS. 7 to 12 are operation explanatory views of the reinforcing bar binding machine 1A.

Figure 7:
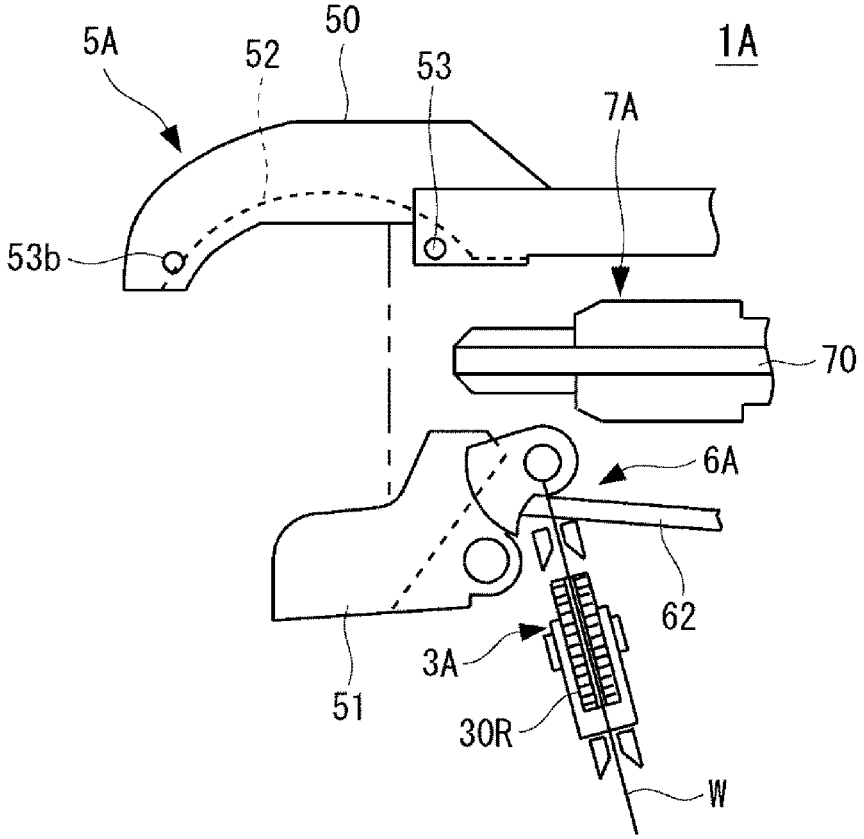
FIG. 7 is an operation explanatory view of the reinforcing bar binding machine according to the first embodiment.

In step S100, the control unit 14A determines whether the trigger switch (a first operation unit) 12A is turned on (a press operation) by a worker (an operator). When the trigger switch 12A is turned on, a corresponding signal is output from the trigger switch 12A. When the signal is detected, the control unit 14A determines that the trigger switch 12A is turned on. The control unit 14A waits until the trigger switch 12A is turned on, and proceeds to step S110 when the trigger switch 12A is turned on. Before the trigger switch 12A is turned on, as shown in FIG. 7, the wire W is sent to the curl guide 5A (an initial state). For convenience of description, a case where the trigger switch 12A is turned on only once within a predetermined time (including not only a case of turning on/off but also a case of keeping on (the case of keeping on may be called "continuously pressing the trigger switch 12A")) may be referred to as "pressing the trigger switch 12A once".

Figure 8:
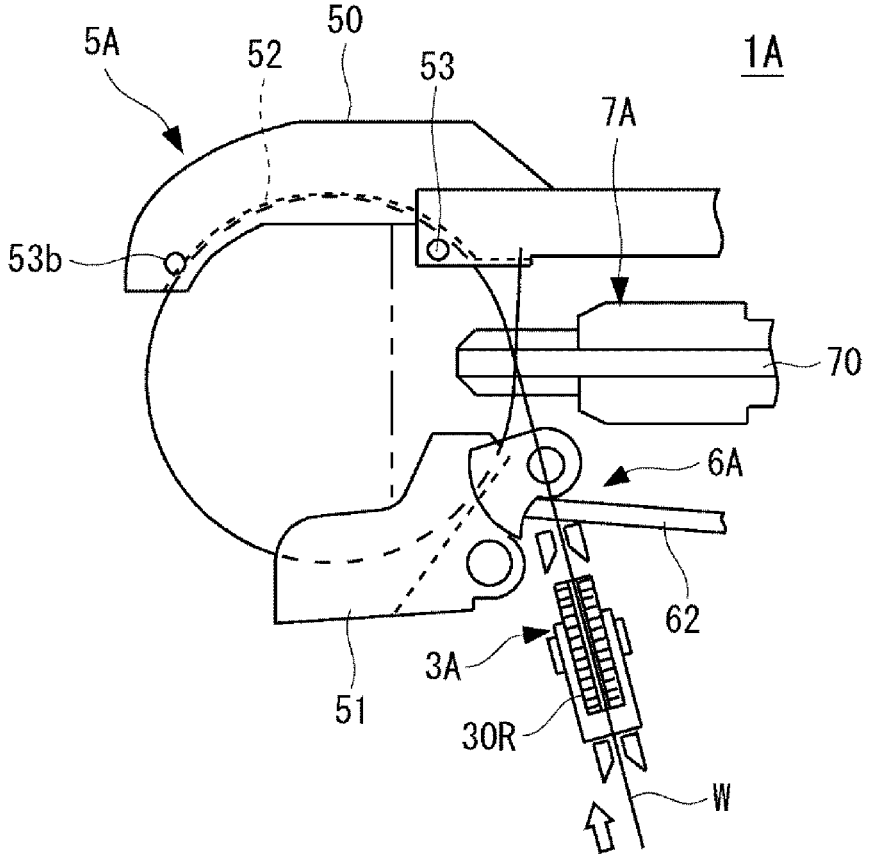
FIG. 8 is an operation explanatory view of the reinforcing bar binding machine according to the first embodiment.

In step S110, the control unit 14A drives the feed motor 33*a* to feed the wire W in a forward direction. As shown in FIG. 8, the wire W fed in the forward direction is formed in an annular wire loop by the curl guide 5A. At this time, the control unit 14A drives the twisting motor 80, and the tip end side of the wire loop is held by the holding portion 70. That is, in step S110, the control unit 14A performs control such that the wire loop is formed and the tip end side of the wire W is held.

In step S120, the control unit 14A determines whether the trigger switch 12A is turned on (a first operation) by the worker. When the trigger switch 12A is turned on, a corresponding signal (a first signal) is output from the trigger switch 12A. When the first signal is detected, the control unit 14A determines that the trigger switch 12A is turned on. The control unit 14A waits until the trigger switch 12A is turned on, and proceeds to step S130 when the trigger switch 12A is turned on, that is, the first signal from the trigger switch 12A is detected.

In step S130, the control unit 14A drives the feed motor 33*a* to feed the wire W in the forward direction. At this time, since the tip end side of the wire loop is held by the holding portion 70, the wire loop is increased (a diameter of the wire loop is expanded) by feeding the wire W (a base end side of the wire loop) in the forward direction (with reference to FIG. 9).

Figure 9:
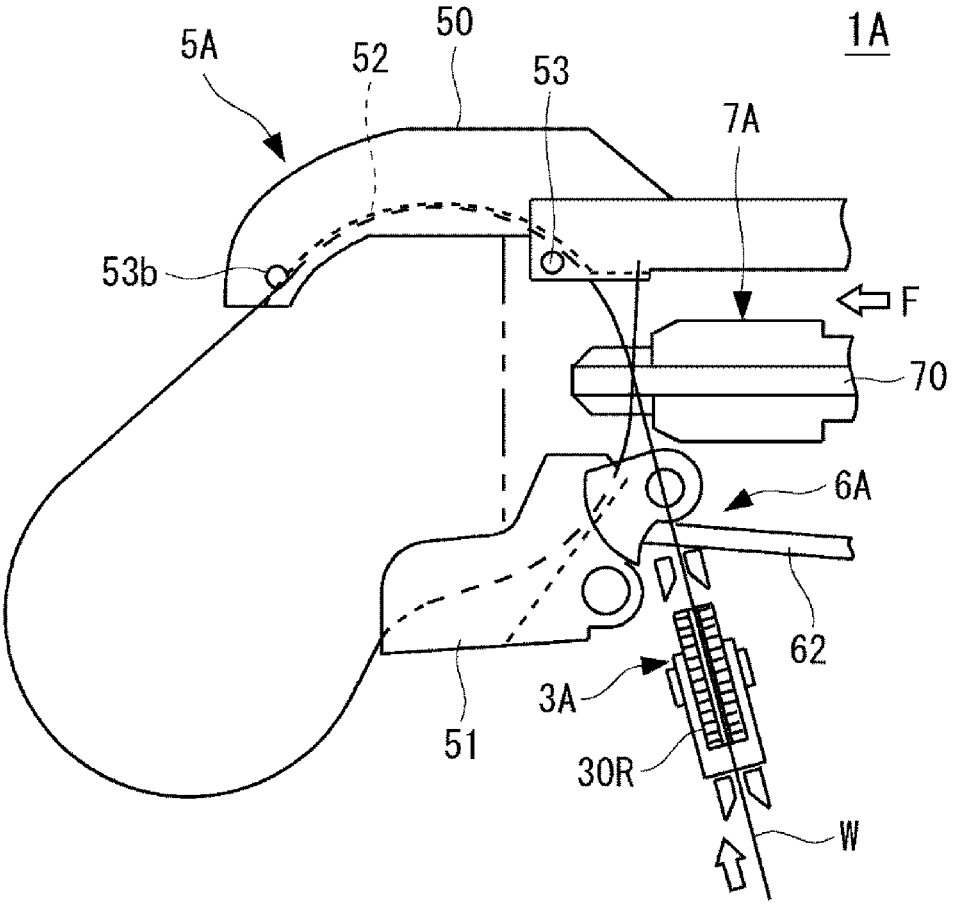
FIG. 9 is an operation explanatory view of the reinforcing bar binding machine according to the first embodiment.

In step S140, the control unit 14A determines whether the trigger switch 12A is turned off by the worker. That is, when the first signal is not detected, the control unit 14A determines that the trigger switch 12A is turned off. The control unit 14A continues feeding the wire W, as shown in FIG. 9, as long as the trigger switch 12A is not turned off, that is, as long as the trigger switch 12A is kept on (in a long-press state) (step S130). By continuing feeding the wire W, the wire loop also continues expanding accordingly. Thus, since a size of the wire loop is changed (expanded) according to the on-time (long-press) of the trigger switch 12A, the worker can freely change the size (diameter) of the wire loop by adjusting the on-time of the trigger switch 12A. On the other hand, when the trigger switch 12A is turned off, the control unit 14A proceeds to the step S150.

In step S150, the control unit 14A stops driving the feed motor 33*a* when the trigger switch 12A is turned off. Therefore, the feed operation of the wire W is also stopped.

In step S160, the control unit 14A determines whether the trigger switch 12A is turned on by the worker. The control unit 14A waits until the trigger switch 12A is turned on, and proceeds to step S170 when the trigger switch 12A is turned on.

When it is determined that the trigger switch 12A is turned on in step S160, in next step S170, the control unit 14A determines whether the trigger switch 12A is pressed twice (two-press (a second operation)) in the present embodiment. The "two-press of the trigger switch 12A" means that the trigger switch 12A is pressed twice within a predetermined time, that is, on, off, and on operations are performed within a predetermined time. When the trigger switch 12A is pressed twice, a corresponding signal (a second signal) is output from the trigger switch 12A. When the second signal is detected, the control unit 14A determines that the trigger switch 12A is pressed twice. When it is determined that the trigger switch 12A is not pressed twice, that is, the trigger switch 12A is pressed once (in this case, the control unit 14A detects the first signal), the control unit 14A returns to step S130, and the wire W is fed again. By turning off the trigger switch 12A (step S140), the expansion (diameter expansion) of the wire loop stops once (step S150), but when the trigger switch 12A is pressed once again (step S170), the wire loop expands again (step S130). On the other hand, when the second signal is detected and it is determined that the trigger switch 12A is pressed twice, the control unit 14A proceeds to step S180.

Figure 10:
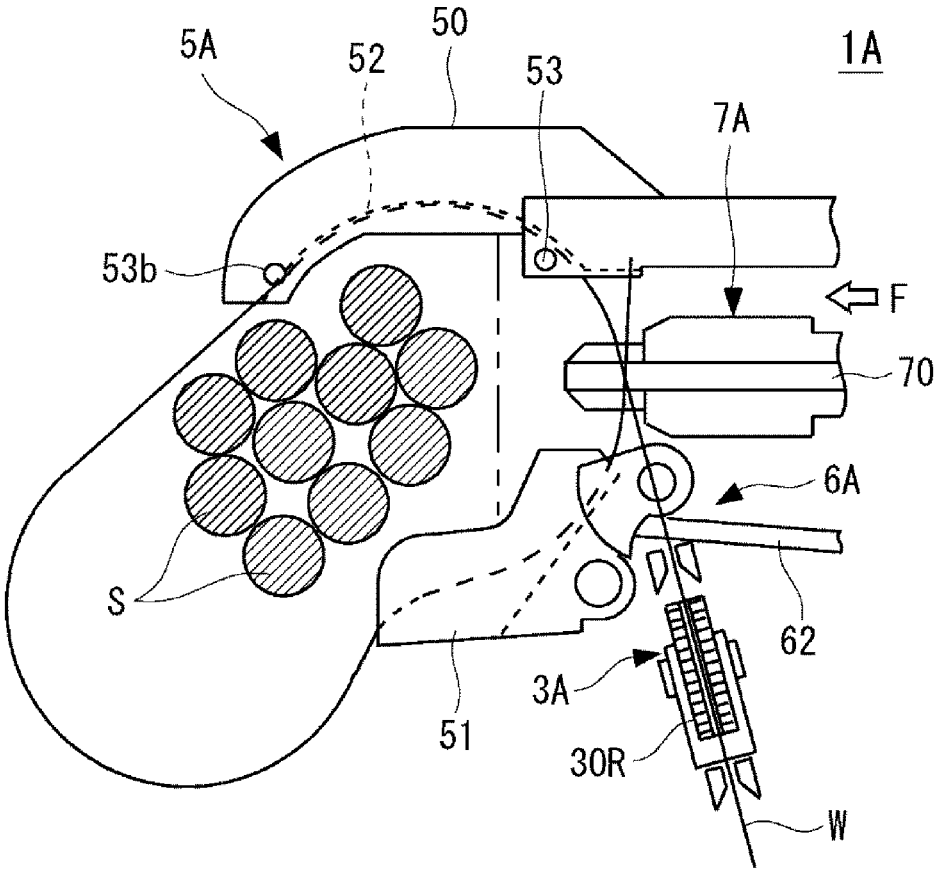
FIG. 10 is an operation explanatory view of the reinforcing bar binding machine according to the first embodiment.
Figure 11:
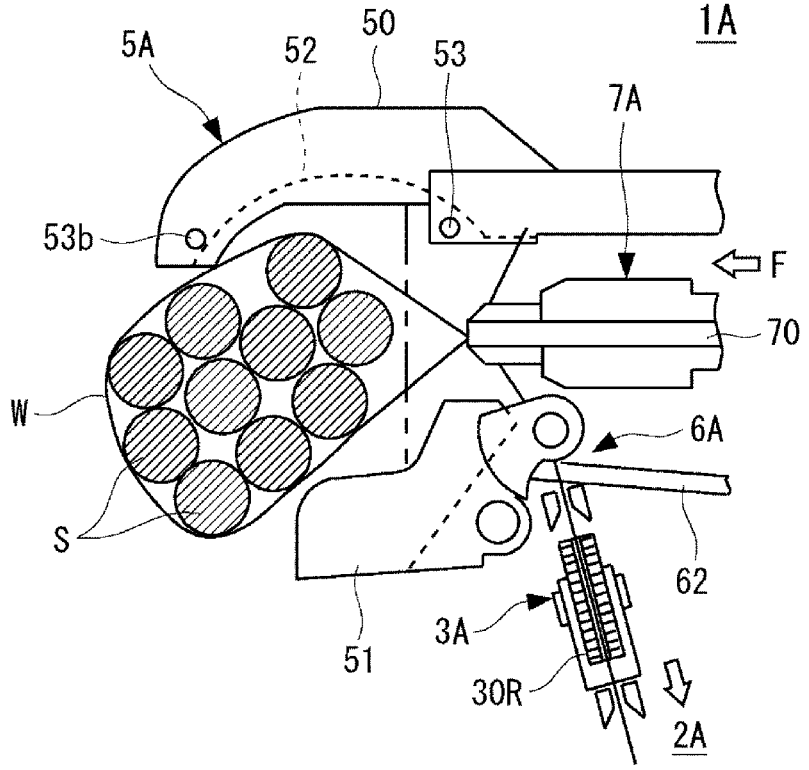
FIG. 11 is an operation explanatory view of the reinforcing bar binding machine according to the first embodiment.
Figure 12:
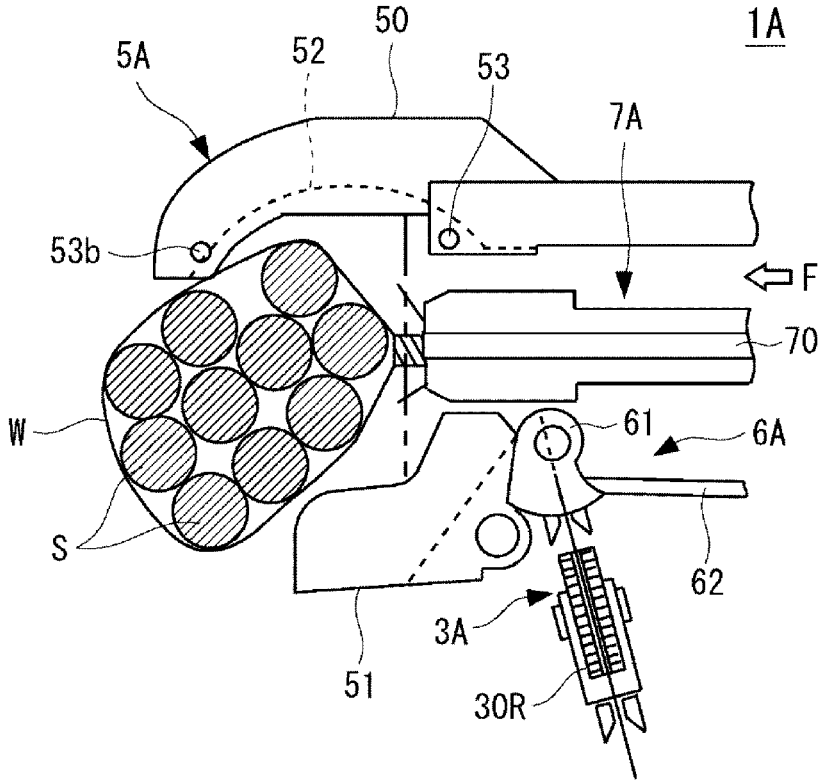
FIG. 12 is an operation explanatory view of the reinforcing bar binding machine according to the first embodiment.

In step S180, the control unit 14A performs a binding operation, that is, operations of pulling back the wire W, cutting the wire W, and twisting the wire W in this order, and ends the processing. Here, before operations of pulling back and twisting the wire W, the worker inserts a plurality of reinforcing bars S, which are binding objects, inside the wire loop, as shown in FIG. 10. Then, after the reinforcing bars S are inserted, the trigger switch 12A is pressed twice (step S170), and the control unit 14A executes the processing of step S180 such as operations of pulling back and twisting the wire W by controlling the feed motor 33*a* and the twisting motor 80. By pulling back the wire W, the wire W is brought into close contact with a periphery of the reinforcing bars, as shown in FIG. 11. Thereafter, the wire W that is cut off binds the reinforcing bars due to the operation of twisting the wire W, as shown in FIG. 12.

Pulling back of the wire W is not essential processing, and the wire W may be cut and twisted without being pulled back.

In the present embodiment, the first operation and the second operation are both performed by the common trigger switch (first operation unit) 12A, but these operations do not necessarily have to be performed by the common trigger switch 12A. That is, these operations may be performed by separate switches. For example, in addition to the trigger switch 12A, a switch (a second operation unit) that outputs a second signal when the second operation is performed may be provided.

In the present embodiment, as long as the trigger switch 12A is continuously pressed, the wire loop continues expanding, but an expansion amount of the wire loop may be limited. That is, even if the trigger switch 12A is continuously pressed, when a feed amount of the wire W reaches a predetermined amount or when the wire loop reaches a predetermined size, the feed of the wire W performed by the feed motor 33*a*, that is, the expansion of the wire loop may be stopped. The feed amount of the wire W or the size of the wire loop may be freely set (to multiple stages) in advance with a dial, a switch, or the like.

In the present embodiment, the first operation is pressing the trigger switch 12A once and the second operation is pressing the trigger switch twice, but both the first operation and the second operation may be pressing the trigger switch 12A a plurality of times, for example, pressing the trigger switch 12A twice in the first operation and pressing the trigger switch 12A three times in the second operation.

In the present embodiment, the first operation is pressing the trigger switch 12A once and the second operation is pressing the trigger switch 12A twice, but both the first operation and the second operation may be pressing the trigger switch 12A once, for example. In this case, by feeding the wire W when the first operation is detected, a wire loop of a predetermined size set by a dial or a switch is formed, and then, the binding operation may be performed while the second operation is performed.

In the present embodiment, after the power is turned on, the wire loop is formed by turning on the trigger switch 12A, but after the power is turned on, the wire loop may be automatically formed without turning on the trigger switch 12A. Further, a wire loop may be formed at the end of previous work. In this case, a wire loop is already formed when next work is to be performed (when the power is turned on).

Second Embodiment

In the reinforcing bar binding machine 1A according to the first embodiment, the wire loop is first formed in a closed state by holding the tip end side and the base end side of the curled wire W, and then the wire loop is expanded by feeding the based on side of the wire loop from this state. However, in a reinforcing bar binding machine 1B according to a second embodiment, the tip end side of the wire W is opened without forming a wire loop as in the first embodiment. That is, instead of expanding the wire loop, the wire W whose tip end side is open is stretched (pulled out) from a front of the body portion 10A. The worker winds the wire W around the reinforcing bars while stretching the wire W to a desired length by a predetermined operation to be described later, and the tip end side of the wire W is held by the holding portion 70. Then, after the tip end side of the wire W is held by the holding portion 70, the binding operation (operations of pulling back the wire W, cutting the wire W, and twisting the wire W) is performed.

Figure 13:
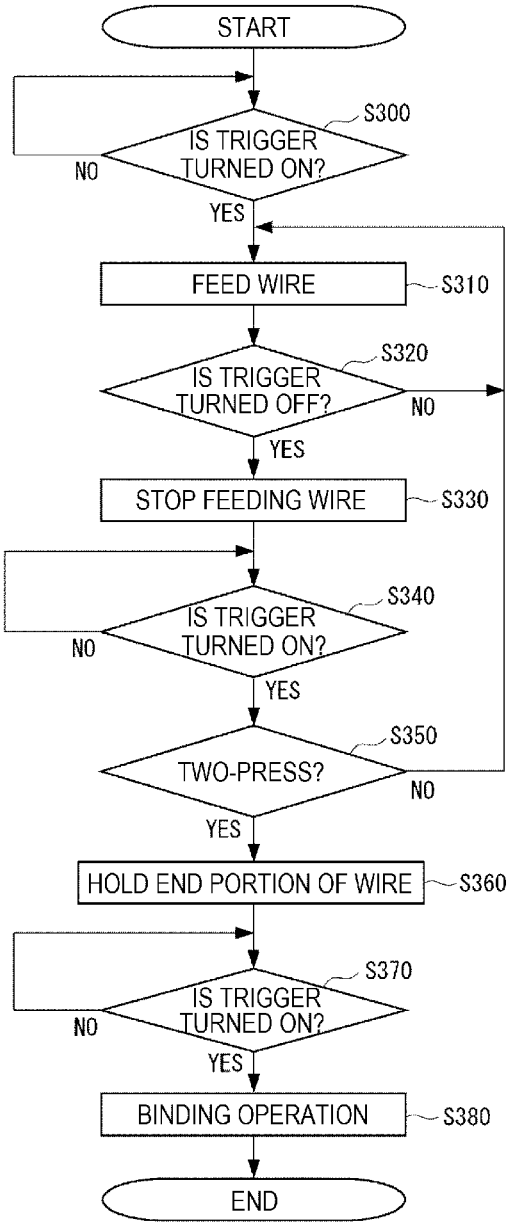
FIG. 13 is a flowchart showing an example of control of a reinforcing bar binding machine according to a second embodiment.

FIG. 13 is a flowchart showing an example of control of the reinforcing bar binding machine 1B according to the second embodiment. The reinforcing bar binding machine 1B executes processing shown in FIG. 13 by executing a program stored in a memory (not shown). Further, FIGS. 14 to 17 are operation explanatory views of the reinforcing bar binding machine 1B.

In step S300, the control unit 14A determines whether the trigger switch (a third operation unit) 12A is turned on (a third operation) by a worker. When the trigger switch 12A is turned on, a corresponding signal (a third signal) is output from the trigger switch 12A. When the third signal is detected, the control unit 14A determines that the trigger switch 12A is turned on. The control unit 14A waits until the trigger switch 12A is turned on, and proceeds to step S310 when the third signal is detected and the trigger switch 12A is turned on.

Figure 14:
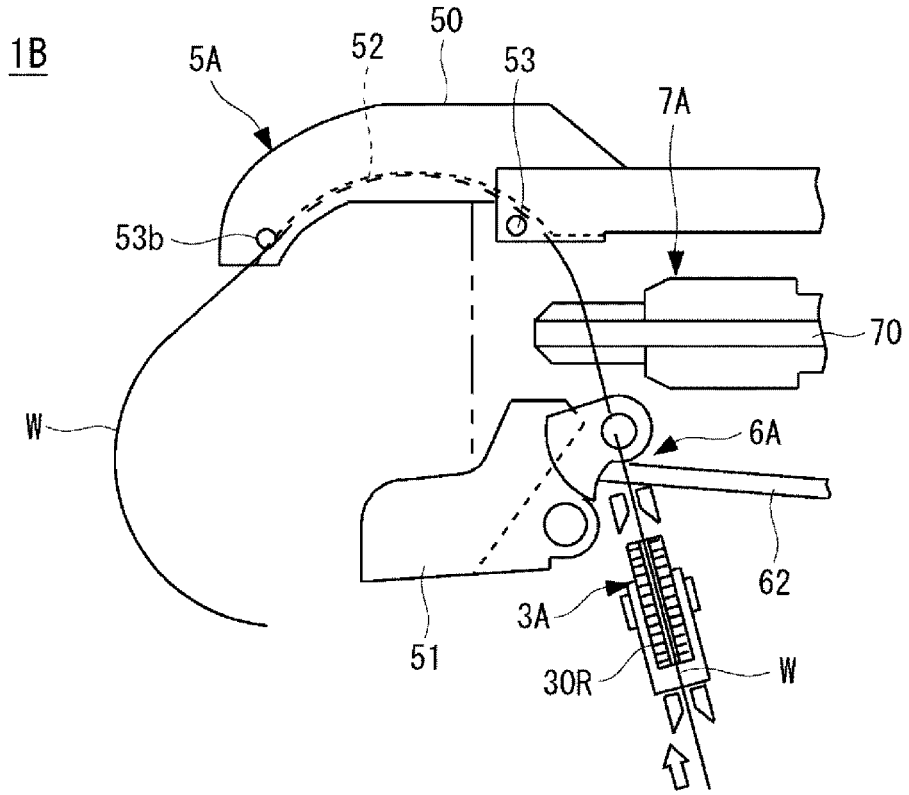
FIG. 14 is an operation explanatory view of the reinforcing bar binding machine according to the second embodiment.
Figure 15:
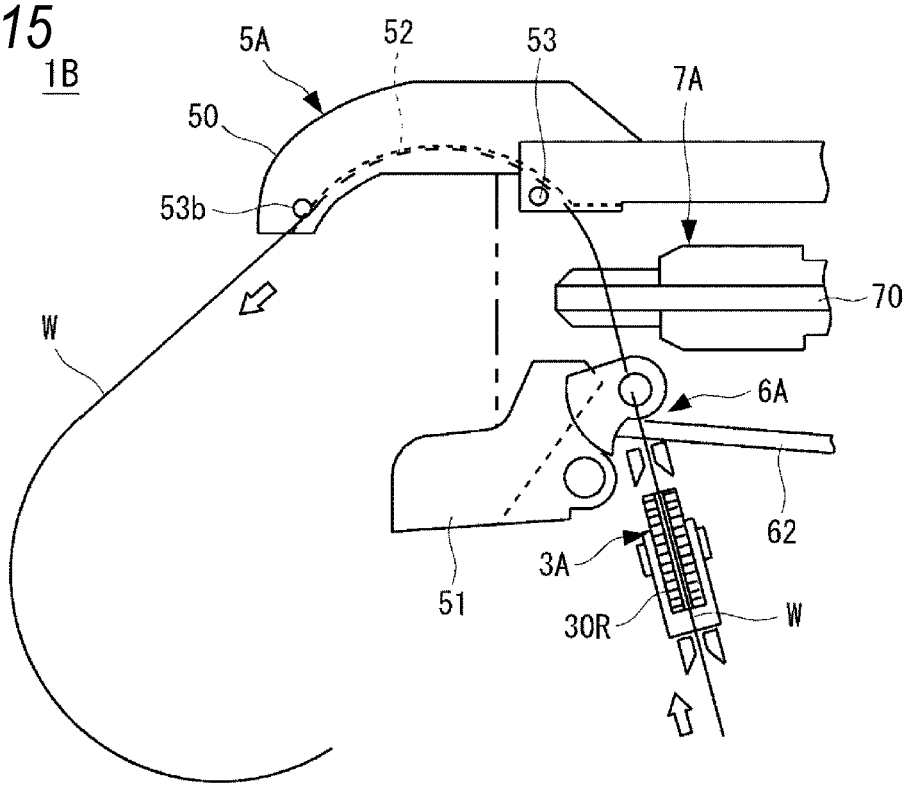
FIG. 15 is an operation explanatory view of the reinforcing bar binding machine according to the second embodiment.

In step S310, the control unit 14A drives the feed motor 33*a* to rotate the first feed gear 30L and the second feed gear 30R in a forward direction, and thus the wire W is fed in a forward direction. At this time, since a tip end side of the wire W is in an open state without being held at all, the wire W is stretched from the first guide portion 50 when the wire W is fed, as shown in FIG. 14.

In step S320, the control unit 14A determines whether the trigger switch 12A is turned off by the worker. Feed of the wire W is continued when the control unit 14A determines that the trigger switch 12A is not turned off, that is, during a period when the trigger switch 12A is kept on (the trigger switch 12A is in a long-press state) (step S310). By continuing to feed the wire W, the wire W continues to stretch from the first guide portion (with reference to FIG. 15). On the other hand, when it is determined that the trigger switch 12A is turned off, the control unit 14A proceeds to step S330.

Figure 16:
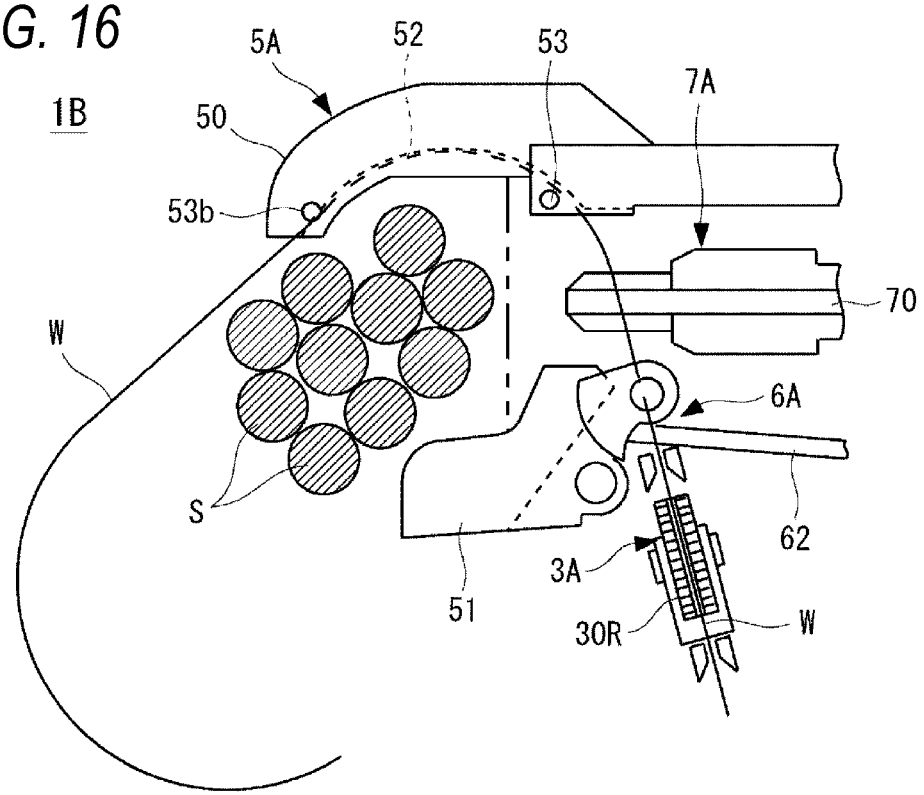
FIG. 16 is an operation explanatory view of the reinforcing bar binding machine according to the second embodiment.

In step S330, the control unit 14A stops driving of the feed motor 33*a* when the trigger switch 12A is turned off. Therefore, the feed operation of the wire W is also stopped. In a stage where the feed operation of the wire W is completed, as shown in FIG. 16, the worker winds the wire W whose tip end side is open around a plurality of reinforcing bars S which are binding objects.

In step S340, the control unit 14A determines whether the trigger switch 12A is turned on by the worker. The control unit 14A waits until the trigger switch 12A is turned on, and proceeds to step S350 when the trigger switch 12A is turned on.

In step S350, the control unit 14A determines whether the trigger switch 12A is pressed a plurality of times, twice in the present embodiment (a fourth operation) by the worker. That is, when a signal (a fourth signal) corresponding to the two-press of the trigger switch 12A is detected, the control unit 14A determines that the trigger switch 12A is pressed twice. When it is determined that the trigger switch 12A is not pressed twice, that is, the trigger switch 12A is pressed once (the third operation), the control unit 14A returns to step S310, and the wire W is fed again. On the other hand, when it is determined that the fourth signal is detected and the trigger switch 12A is pressed twice, the control unit 14A proceeds to step S360.

Figure 17:
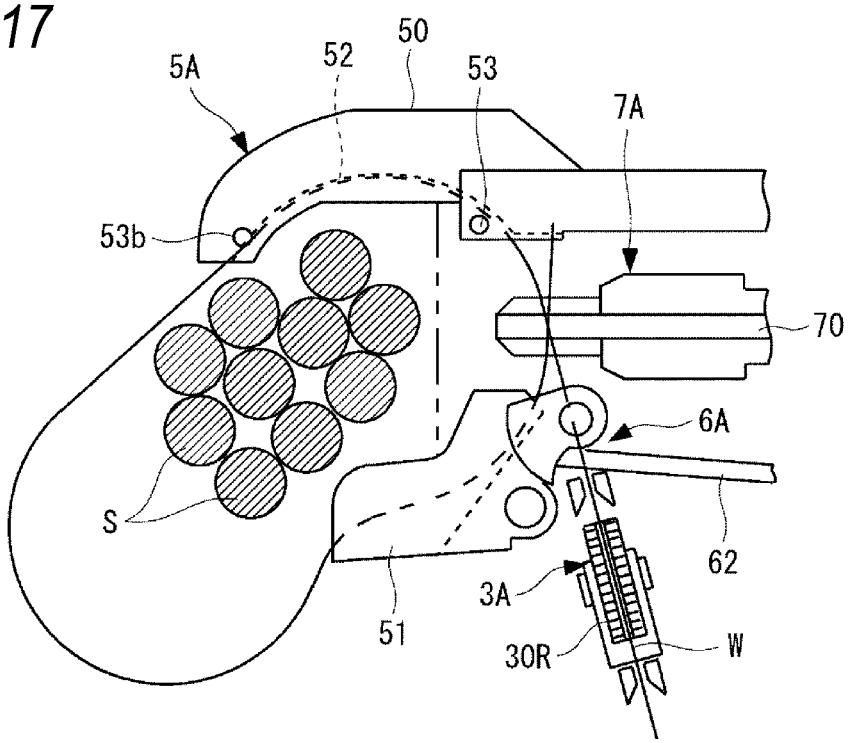
FIG. 17 is an operation explanatory view of the reinforcing bar binding machine according to the second embodiment.

In step S360, the control unit 14A drives the twisting motor 80 to cause the holding portion 70 to hold the tip end portion of the wire W (with reference to FIG. 17). Here, in order to hold the tip end side of the wire W, the worker needs to set the tip end side of the wire W in the holding portion 70 in advance. The worker sets the tip end side of the wire W in the holding portion 70, and then presses the trigger switch 12A twice.

In step S370, the control unit 14A determines whether the trigger switch 12A is turned on (a fifth operation) by the worker. That is, when a signal (a fifth signal) corresponding to turning on of the trigger switch 12A is detected, the control unit 14A determines that the trigger switch 12A is turned on. The control unit 14A waits until the trigger switch 12A is turned on by the worker, and proceeds to step S380 when the trigger switch 12A is turned on.

In step S380, the control unit 14A performs a binding operation, that is, operations of pulling back the wire W, cutting the wire W, and twisting the wire W in this order, and ends the processing. Since the processing here is the same as that of the first embodiment, detailed description thereof will be omitted.

In the present embodiment, the pulling back of the wire W is not necessarily essential processing, as in the first embodiment. Further, the third operation, the fourth operation, and the fifth operation do not necessarily have to be performed on the common trigger switch (the third operation unit) 12A, and may be performed on different switches. For example, in addition to the trigger switch 12A, a switch (a fourth operation unit) that outputs a fourth signal when the fourth operation is performed and a switch (a fifth operation unit) that outputs a fifth signal when the fifth operation is performed may be provided.

In the present embodiment, the third operation is pressing the trigger switch 12A once, and the fourth operation is pressing the trigger switch twice, and the fifth operation is pressing the trigger switch 12A once, but the third operation, the fourth operation and the fifth operation may be pressing the trigger switch 12A a plurality of times, for example, pressing the trigger switch 12A twice in the third operation, pressing the trigger switch 12A three times in the fourth operation, and pressing the trigger switch 12A four times in the fifth operation.

In the present embodiment, as long as the trigger switch 12A is continuously pressed, the wire loop continues stretching, but a stretching amount of the wire loop may be limited. That is, even if the trigger switch 12A is continuously pressed, when the wire W reaches a predetermined length, further stretching may be stopped. For example, when the stretching amount (feed amount) of the wire W reaches a predetermined amount, the feed motor 33*a* may be stopped to stop the feed of the wire W. The stretching amount (feed amount) of the wire W may be freely set with a dial, a switch, or the like.

In the present embodiment, the curl guide for giving a curl nature to the wire W is provided, but the curl guide 5A is not an essential configuration because the wire W does not necessarily have to be curled.

As described above, according to the first and second embodiments, the size of the wire loop and the stretching amount (pulling amount) of the wire W can be freely adjusted by adjusting the on-time (long-press time) of the trigger switch 12A. Therefore, by adjusting the size of the wire loop or the stretching amount of the wire W to correspond to the number and thickness of the reinforcing bars S, the number and size of reinforcing bars that cannot be bound by a reinforcing bar binding machine in the related art can also be bound. That is, since the size of the wire loop and the stretching amount of the wire W can be adjusted in a stepless manner by operating the trigger switch 12A, the binding can be performed even if the binding objects have various sizes.

Further, in the first embodiment, since it is necessary to insert the reinforcing bars S into a closed annular wire loop, the wire loop needs to be brought to end portions of the reinforcing bars S and a ring of the wire loop needs to be inserted from the end portions of the reinforcing bars S in order to bind the reinforcing bars S. However, in the second embodiment, since the tip end side of the wire W is open (because the tip end side of the wire W is not closed), the wire W can be wound directly around the reinforcing bars S at a place where the binding is desired without the need of bringing the wire W to the end portions of the reinforcing bars S.

The technical scope of the present invention is not limited to the above-described embodiments, and includes various modifications of the above-described embodiments without departing from the spirit of the present invention.

For example, in the embodiments described above, the tip end side of the wire loop or the wire W is held by the holding portion 70 of the binding unit 7A, but the holding portion 70 may be provided separately from the binding unit 7A instead of being provided in the binding unit 7A. For example, the holding portion 70 may be provided in the body portion 10A or the curl guide 5A rather than the binding unit 7A.

The control according to the first embodiment and the control according to the second embodiment may both be performed in one reinforcing bar binding machine. In this case, for example, a mode for performing the control according to the first embodiment and a mode for performing the control according to the second embodiment may be provided, and these modes can be selected.

In the embodiments described above, the reinforcing bar S has been described as an example of the binding object, but the binding object is not limited to the reinforcing bar S. For example, the binding object may be an elongated object such as a pipe, and a material thereof is not limited to iron and may be a resin or the like. Further, the binding object is not limited to industrial materials, and may be, for example, branches or vines of fruit trees and vegetables, wooden columns, and the like.

In the embodiments described above, the wire W has been described as an example of a wire rod for binding a binding object, but the wire rod is not limited to the wire W. In the first embodiment, since it is necessary to form a wire loop by the curl guide 5A, a plastically deformable wire is required, but in the second embodiment, for example, a wire rod made of a flexible member such as a resin tape, a rope twisted with a string, or the like that does not undergo plastic deformation may be used.

Figure 18:
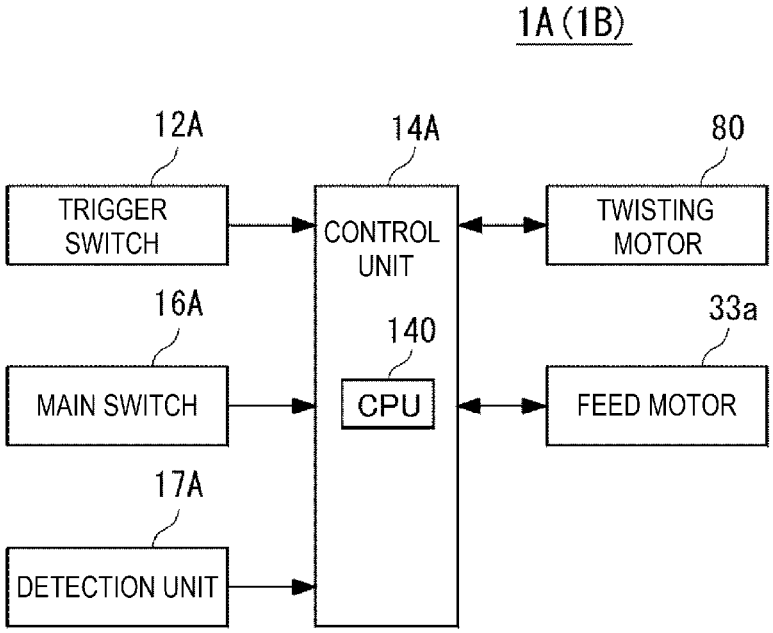
FIG. 18 is a block diagram showing an example of a control function of a reinforcing bar binding machine according to a modification of the first and second embodiments.

In the first embodiment, the binding operation of the wire W is performed based on the operation of the trigger switch 12A. Specifically, after the reinforcing bars S that are binding objects are inserted inside the wire loop, the trigger switch 12A is pressed twice to perform the binding operation, that is, operations of pulling back the wire W, cutting the wire W, and twisting the wire W. In contrast, for example, the binding machine may be configured such that it can be detected that the reinforcing bars S are inserted inside the wire loop, and the binding operation may be automatically performed without operating the trigger switch 12A when the reinforcing bars S are detected. In the reinforcing bar binding machine 1A, a detection unit 17A for detecting a binding object (the reinforcing bar S, and the like) is provided in the body portion 10A or the curl guide 5A, and as shown in FIG. 18, the detection unit 17A is connected to the control unit 14A. The detection unit 17A is configured to output a second signal when a binding object (the reinforcing bar S or the like) is detected inside the wire loop. The control unit 14A that detects the second signal controls the feed motor 33*a* and the twisting motor 80 to perform the binding operation (step S180 in FIG. 6).

In the second embodiment, the binding operation (steps S370, 380 in FIG. 13) may also be automatically performed without operating the trigger switch 12A after the wire W is held, instead of performing the binding operation by operating the trigger switch 12A after the tip end side of the wire W is held (step S360 in FIG. 13). Specifically, as described above, the detection unit 17A is provided on the body portion 10A or the curl guide 5A and is connected to the control unit 14A. The detection unit 17A is configured to output a fifth signal when a binding object is detected inside the wire W whose tip end side is held, and the control unit 14A that detects the fifth signal controls the feed motor 33*a* and the twisting motor 80 to perform the binding operation (step S380 in FIG. 13).

A detection method based on the detection unit 17A is not limited to a specific method, and for example, any of a contact sensor which detects that a binding object is in contact with a limit switch or the like; a non-contact sensor which detects the binding object based on reflected light or reflected wave of projected light or a transmitted ultrasonic wave; and an image sensor which detects a binding object by processing an image taken by a camera may be used.

The present application is based on Japanese Patent Application No. 2018-135390 filed on Jul. 18, 2018, the contents of which are incorporated herein by reference.

REFERENCE SIGNS LIST

1A reinforcing bar binding machine (binding machine)
3A wire feed unit (feed unit)
7A binding unit (twisting unit)
10A body portion
12A trigger switch (first operation unit, third operation unit)
14A control unit
17A detection unit
70 holding portion
W wire

The invention claimed is:

1. A binding machine comprising:
a holding portion configured to hold a tip end side of a curled wire rod;
a feed unit configured to hold a base end side of the wire rod, the tip end side of which is held by the holding portion, such that the base end side of the wire rod is able to be fed out;
a twisting unit configured to twist the wire rod;
a curl guide configured to guide the wire rod fed by the feed unit to form a closed annular wire loop, the curl guide including a first guide portion and a second guide portion; and
a control unit configured to control the feed unit and the twisting unit, wherein
the control unit is configured to control the feed unit to feed the wire rod when detecting a first signal, and is configured to control the twisting unit to twist the wire rod when detecting a second signal, and
the closed annular wire loop is formed by the holding portion and the feed unit, and a diameter of the annular wire loop is configured to be expanded according to a size of a binding object by the feeding of the wire rod,
wherein the curl guide includes an opening between the first guide portion and the second guide portion such that the diameter of the closed annular wire loop is expandable through the opening when fed by the feed unit.

2. The binding machine according to claim 1 further comprising: a first operation unit configured to output the first signal when a first operation is performed by an operator.

3. The binding machine according to claim 2, wherein the first operation unit is configured to output the second signal when a second operation is performed by the operator.

4. The binding machine according to claim 1 further comprising: a second operation unit configured to output the second signal when a second operation is performed by an operator.

5. The binding machine according to claim 1, wherein
the feed unit is configured to pull back the base end side of the wire rod, the tip end side of which is held, and
when detecting the second signal, the control unit is configured to control the feed unit to pull back the wire rod, and then is configured to control the twisting unit to twist the wire rod.

6. The binding machine according to claim 3, wherein
the first operation unit is a trigger switch, and
one of the first operation and the second operation is a one-press operation, and the other of the first operation and the second operation is a multiple-time-press operation.

7. The binding machine according to claim 1 further comprising:
a detection unit configured to output the second signal when a binding object is located inside the curled wire rod.

8. The binding machine according to claim 1, wherein
in a case where the control unit detects the first signal so as to feed the wire rod, when a feed amount of the wire rod reaches a predetermined amount, the control unit is configured to stop the feed of the wire rod.

9. A binding machine comprising:
a body portion;
a holding portion configured to hold a tip end side of a curled wire rod;
a feed unit configured to hold a base end side of the wire rod, the tip end side of which is held by the holding portion, such that the base end side of the wire rod is able to be fed out;
a twisting unit configured to twist the curled wire rod;
a curl guide configured to guide the wire rod fed by the feed unit to form a closed annular wire loop, the curl guide including a first guide portion and a second guide portion; and
a control unit configured to control the feed unit to feed the wire rod when detecting a first signal, and is configured to control the twisting unit to twist the wire rod when detecting a second signal, wherein
a closed annular wire rod is formed on a tip end side of the body portion by the holding portion and the feed unit, a diameter of the annular wire rod is able to be expanded by feeding the base end side of the wire with the feed unit, and wherein the curl guide includes an opening between the first guide portion and the second guide portion such that the diameter of the closed annular wire loop is expandable through the opening when fed by the feed unit.

* * * * *